United States Patent [19]

Brandis et al.

[11] 3,961,006

[45] June 1, 1976

[54] PRODUCTION OF FLATS FOR CARDING MACHINES

[75] Inventors: Curt Brandis, Bremen-St. Magnus; Peter Müller, Bremen-Lesum, both of Germany

[73] Assignee: Fried. Krupp Gesellschaft mit beschrankter Haftung, Essen, Germany

[22] Filed: Nov. 12, 1974

[21] Appl. No.: 523,152

[30] Foreign Application Priority Data

Dec. 14, 1973 Germany ..... 2362206

[52] U.S. Cl. ..... 264/138; 264/231; 264/261; 264/271; 264/274

[51] Int. Cl.[2] ..... B29C 17/08; B29D 3/00; B29D 31/00

[58] Field of Search ..... 264/261, 219, 243, 229, 264/231, 271, 274, 277, 313, 138, 262, 267, 229, 249, 279, 163; 19/113, 99, 110, 233, 102, 104; 29/418, 452

[56] References Cited

UNITED STATES PATENTS 3,529,054 9/1970 Hepner ..... 264/277

FOREIGN PATENTS OR APPLICATIONS 466,142 5/1914 France ..... 19/99

*Primary Examiner*—Willard E. Hoag
*Attorney, Agent, or Firm*—Spencer & Kaye

[57] ABSTRACT

A flat composed of a flat body with a flexible covering fastened thereto and having a plurality of outwardly extending card wires distributed across the covering, for use in carding machines, is produced by disposing such a flexible covering against the outer surface of a cylinder with the outwardly extending wires directed toward the cylinder surface, the outer surface of the cylinder being shaped to define the desired contour of the array of card wire tips; pressing the flexible covering against the outer surface of the cylinder for causing the array of card wire tips to conform to the shape of the outer surface of the cylinder; disposing an associated flat body at a distance from that surface of the covering which is directed away from the cylinder; and filling the region between the flexible covering and the rigid body with a hardenable plastic mass and permitting the mass to harden and to become firmly attached to the flat body and to the covering.

4 Claims, 4 Drawing Figures

PRODUCTION OF FLATS FOR CARDING MACHINES

BACKGROUND OF THE INVENTION

The present invention relates to a cover or flat which is used in carding machines and which includes a rigid flat body and a flexible covering fastened thereto and provided with an offset arrangement of outwardly extending card wires.

Carding machines substantially include a rotatable drum or roller whose outer surface is covered with a plurality of teeth and a flat provided with a card clothing, the flat normally enclosing part of the outer surface and being either stationary or movable to a slight degree with respect to the drum or roller. The tips of the card clothing on the flat, which are almost in contact with the outer surface of the drum or roller, perform the carding action together therewith.

German Offenlegungsschrift [Laid-Open Patent Application] No. 1,938,539, filed on July 29th, 1969 and laid open on Feb. 26th, 1970, discloses a flat for carding machines whose surface facing the drum is covered with card wires which protrude only slightly with respect to the associated embedded portions. The card wires, for example short pieces of wire, are fastened by means of flexible or stiff materials which extend in layers across the entire length and breadth of the flat.

The manufacture of flats for carding machines is relatively costly since the interior surface which is provided with the card clothing, i.e. the flexible covering, must be very precisely adjusted.

SUMMARY OF THE INVENTION

It is an object of the present invention to provide a method for producing the flat for a carding machine in a precise manner without unduly high cost.

Further objects of the invention are to produce a flat having sufficient rigidity and designed to prevent shifting of the flexible covering with respect to the supporting flat body.

The objects according to the invention are achieved by a method for producing a flat which includes stretching the flexible covering against the outer surface of a cylinder of suitable diameter before the covering is fastened to the flat body, thereafter arranging the flat body at a distance above the outwardly directed surface of the covering and then filling the space between the flat body and the flexible covering with a kneadable or moldable plastic mass which is subsequently hardened.

According to one specific embodiment of the method, tensioning elements are placed, before the flat body is attached, across the outwardly directed surface of the covering in the peripheral direction, the ends of the tensioning elements being fastened to the outer surface of the cylinder so as to be placed under tension. The tension is produced by connecting the ends of the tensioning elements to tension springs whose free ends are pulled, by stretching them, over holding elements fastened to the outer surface of the cylinder. In one embodiment of the process of the present invention, the protruding ends of the tensioning elements are cut off upon completion of the hardening of the plastic mass.

By pressing the flexible covering against a suitable countersurface it is accomplished that the tips of the card wires fastened to the flexible covering are aligned with the contour of that countersurface and are fixed during the hardening of the plastic mass in the flat in the precise dimensions intended for them.

Moreover, the process eliminates costly machining of the inner surfaces of the cover body since the space between this surface and the outwardly directed surface of the covering can easily be filled with the plastic mass.

In order to produce a particularly good connection with the plastic, at least one of the two parts connected to the plastic, i.e., the flat body or the flexible covering, is provided on its side facing the plastic mass with eye-type protrusions.

The longitudinal rigidity of the flat can be improved by placing a corrugated reinforcement metal sheet onto the inner surface of the flat with the corrugations extending parallel to the axis of curvature of the flat.

The rigidity of the flat can also be increased by providing the flat body on its exterior surface with a supporting structure comprising longitudinal and transverse metal sheets placed on edge.

The present invention will now be described in detail for some embodiments which are illustrated in the drawings.

DESCRIPTION OF THE PREFERRED EMBODIMENTS

Figure 1:
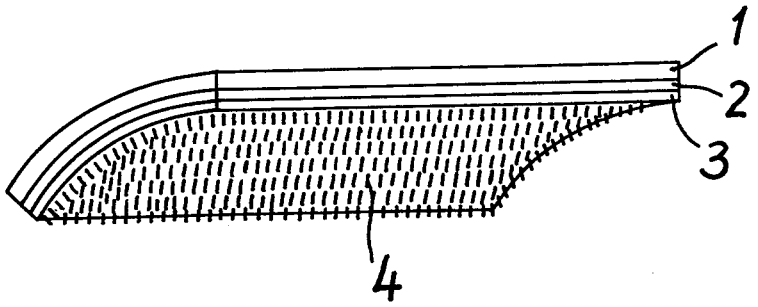
FIG. 1 is a perspective view of the interior of a flat according to the invention.

FIG. 1 shows the structure of a flat produced according to the present invention. The exterior portion of the flat is composed of a curved metal plate which forms the flat body, or rigid support body, 1. The portion of the flat which is intended to face the associated roller or drum (not shown) is composed of a covering 3 of a flexible material in which card wires 4 are disposed. The tips of the card wires are directed toward the associated roller.

Between parts 1 and 3 there is disposed a layer constituted by a hardened plastic mass 2 which is fastened to the interior surface of the flat body 1 as well as to that surface of covering 3 which faces the flat body.

Figure 2:
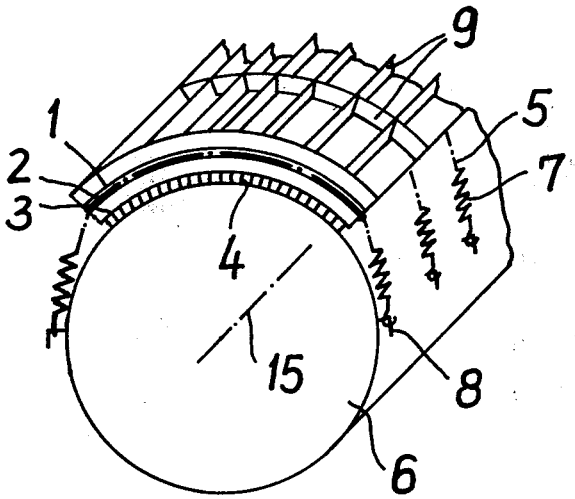
FIG. 2 is a perspective view of an arrangement used for producing the flat of FIG. 1.

As shown in FIG. 2, the flat is produced by initially stretching, or pressing, the flexible covering 3 beneath wires 5 or a wire netting extending in the peripheral direction of a cylinder 6 serving as a countersurface, the tips of the card wires 4 resting on the outer surface of cylinder 6.

The tension to be placed on wires 5 is produced by tension springs 7 each having one end connected to the end of a respective one of the wires protruding beyond the covering 3. The free ends of the tension springs which preferably have the form of an eye, are pulled over hooks 8 which are fastened to cylinder 6 at a suitable distance from the lateral edges of covering 3.

The wires 5 may extend between corresponding tension springs over the whole peripheral width of the covering 3 or may be fastened to the above-mentioned wire netting; they serve to transmit the tension of the springs 7 to the covering 3 and the card wires 4, so that they rest regularly upon the surface of cylinder 6 and are accurately fixed to the flat body 1 by the plastic mass 2.

The flat body 1, which is reinforced on its exterior surface by a supporting structure of longitudinal and transverse metal webs 9, is placed and fastened by separate supports (not shown), at a suitable distance above the flexible covering 3. Subsequently the space between parts 3 and 1 is filled with a hardenable plastic mass 2. This mass may be, for example an epoxy resin and a hardener which is exposed for about 1 to 2 hours to a temperature of about 60°C in order to harden it. The hardenable plastic mass 2 should be filled in at room temperature and its hardening should be effected by means of the influence of the weight of flat body 1.

After the hardening of the plastic layer 2, the lateral ends of the wires 5 serving as the tensioning elements are cut off; the sections of wire disposed inside the flat remain within the plastic layer.

The covering 3, which supports the card wires 4 in the manner known from the construction of card coverings, may consist of rubber, synthetic material, textile or a combination of these materials. Furthermore the covering 3 may be composed of a single plate or several plates, being placed longitudinally or transversely. The thickness of covering 3 is about 5 to 10 mm (millimeters), the card wires 5 projecting beyond the covering at a rate of about 1 to 2 mm (millimeters).

The cylinder 8 has a diameter of 0.5 to 1.5 m (meters), for example. The tension force transmitted to the wires 5 should have such an amount, that on each cm (centimeter) of peripheral width of the outer surface of cylinder 6 is exercised a tractive power in the range of 10 Kp (ten kiloponds).

The distance between parts 1 and 3 may have an amount of about 3 to 6 mm (millimeters), for example.

Figure 3:
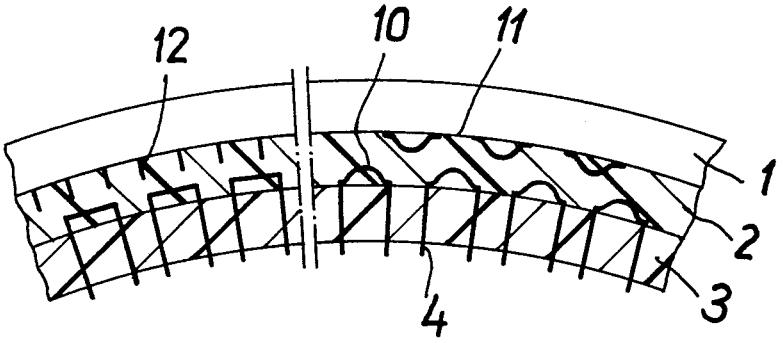
FIGS. 3 and 4 are cross-sectional views of two different configurations of flats according to the invention.

In order to improve the connection between the covering 3 and the plastic mass 2, the card wires 4 may be provided with eyes 10 on their rear sides, as shown in FIG. 3. The surface of the flat body 1 facing the plastic mass 2 can correspondingly be provided with eyes 11 or protrusions 12.

Figure 4:
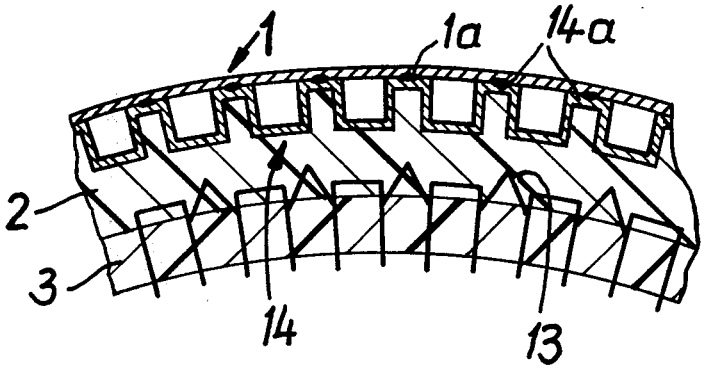

FIG. 4 shows a flat whose covering 3 is additionally provided with triangularly bent holding members 13 which extend into the plastic mass 2. In this embodiment, a corrugated reinforcing metal sheet 14 is placed onto the interior of the flat body 1 with its corrugations disposed parallel to the axis of curvature of the cover, i.e. the longitudinal axis 15 of the cylinder 6 serving as the countersurface. The reinforcing metal simultaneously improves the connection between the plastic mass 2 and the flat body 1.

The connection between the flat body 1 — a curved plate having a thickness of 2 mm (millimeters), for example — and the metal sheet 14 also having a thickness of 2 mm (millimeters) is achieved by spot-welding the sections 1*a* and 14*a* being in contact with each other.

It will be understood that the above description of the present invention is susceptible to various modifications, changes and adaptations, and the same are intended to be comprehended within the meaning and range of equivalents of the appended claims.

We claim:

1. A method for producing a flat for use in carding machines, the flat being composed of a rigid support body with a flexible covering fastened thereto, the covering having one side facing the body and the covering further having a plurality of card wires projecting from the covering at a side thereof directed away from the rigid body and distributed across the covering, said method comprising the steps of: disposing a flexible covering, having plural projecting wires, adjacent a convex cylindrical surface with the projecting wires directed toward the surface, the convex surface being shaped to define the desired contour of the card wire tips; pressing the flexible covering toward the cylindrical surface to cause the tip of each of the card wires to touch the cylindrical surface; disposing an associated rigid support body radially spaced from a surface of the covering which is directed away from the cylindrical surface; filling the space between the flexible covering and the rigid body with a hardenable plastic mass, causing said mass to harden and causing said mass to become firmly attached to said rigid body and to said covering, while the flexible covering is being pressed against the cylindrical surface; and then removing the resulting flat from the cylindrical surface.

2. Method as defined in claim 1 wherein said step of pressing is carried out by placing tensioning elements over the surface of the flexible covering which faces away from the cylindrical surface so that the elements extend in the peripheral direction of the cylindrical surface, and fastening ends of said tensioning elements to a portion of the cylindrical surface remote from the surface portion adjacent the flexible covering in a manner to place the elements under tension.

3. Method as defined in claim 2 wherein said step of fastening is carried out by connecting at least one end of each said tensioning element to a tension spring whose free end is pulled over a holding member disposed on the cylindrical surface.

4. Method as defined in claim 2 comprising the final step of cutting off the portions of the tensioning elements which protrude from the flat after the plastic mass has hardened.

* * * * *